United States Patent [19]

Limburg et al.

[11] 4,055,420

[45] Oct. 25, 1977

[54] SINGLE PHASE ORGANIC PHOTOCONDUCTIVE COMPOSITION

[75] Inventors: William W. Limburg, Penfield; Damodar M. Pai, Fairport, both of N.Y.

[73] Assignee: Xerox Corporation, Stamford, Conn.

[21] Appl. No.: 763,275

[22] Filed: Jan. 27, 1977

[51] Int. Cl.[2] ..... G03Q 5/06

[52] U.S. Cl. ..... 96/1.5 N

[58] Field of Search ..... 96/1.5

[56] References Cited

U.S. PATENT DOCUMENTS

| | | | |
|---|---|---|---|
| 3,189,447 | 6/1965 | Neugebauer et al. | 96/1.5 |
| 3,870,516 | 3/1975 | Smith et al. | 96/1.5 |
| 3,871,882 | 3/1975 | Wiedemann et al. | 96/1.5 |
| 3,978,029 | 8/1976 | Limburg | 96/1.5 X |
| 4,006,017 | 2/1977 | Williams et al. | 96/1.5 X |

FOREIGN PATENT DOCUMENTS

| | | | |
|---|---|---|---|
| 834,502 | 5/1960 | United Kingdom | 96/1.5 |

OTHER PUBLICATIONS

"On Photoelectric Effects in Polymers and Their Sensitization by Dopants", Hoegl, Jour. Phys. Chem., vol. 69, No. 3, Mar. 1965, pp. 755–766.

*Primary Examiner*—Roland E. Martin, Jr.
*Attorney, Agent, or Firm*—James J. Ralabate; James P. O'Sullivan; Gaetano D. Maccarone

[57] ABSTRACT

There is described a single phase organic photoconductive composition consisting of a solid solution of N-ethyl-3-tricyanovinylcarbazole and 2,5-bis(N,N-dimethylaminophenyl) oxadiazole in a polycarbonate binder material. The composition exhibits a shallow field dependence for the photogeneration of charge carriers and thus provides a high contrast potential photoconductive system.

6 Claims, 5 Drawing Figures

SINGLE PHASE ORGANIC PHOTOCONDUCTIVE COMPOSITION

BACKGROUND OF THE INVENTION

This invention is directed to photoconductive compositions, articles and imaging processes. More specifically, this invention is directed to photoconductive solid solutions having a shallow field dependence for photogeneration of charge carriers.

The formation and development of imges of the imaging surfaces of photoconductive materials by electrostatic means is well known. The best known of the commercial processes, more commonly known as xerography, involves forming an electrostatic latent image on the imaging surface of an imaging member by first uniformly electrostatically charging the surface of the imaging layer in the dark and then exposing this electrostatically charged surface to an imagewise pattern of activating electromagnetic radiation. The light-struck areas of the imaging layer are thus rendered relatively conductive and the electrostatic charge selectively dissipated in these irradiated areas. After the photoconductor is exposed, the electrostatic latent image on this image bearing surface is typically rendered visible with a finely divided colored marking material, known in the art as "toner". This toner will be principally attracted to those areas on the image bearing surface which retain the electrostatic charge and thus form a visible powder image. The electrostatic latent image may also be used in a host of other ways as, for example, electrostatic scanning systems may be employed to "read" the latent image or the latent image may be transferred to other materials by TESI techniques and stored. A developed image can then be read or permanently afixed to the photoconductor where the imaging layer is not to be reused. This latter practice is usually followed with respect to a so-called "binder-type" photoconductive film, e.g., zinc oxide in an electrically insulating binder resin, where the photoconductive layer is also an integral part of the finished copy.

In so-called "plain paper" copying systems, the latent image can be developed on the imaging surface of a reusable photoconductor or transferred to another surface, such as a sheet of paper, and thereafter developed. When the latent image is developed on the imaging surface of a reusable photoconductor, it is subsequently transferred to another substrate and then permanently affixed thereto. Any one of a variety of well known techniques can be used to permanently affix the toner image to the copy sheet, including overcoating with transparent films, and solvent or thermal fusion of the toner particles to the supportive substrate.

In the above "plain paper" copying systems, the materials used in the photoconductive layer should preferably be capable of rapid switching from an insulating to a conductive and back to the insulating state in order to permit cyclic use of the imaging surface. The failure of the material to return to its relatively insulating state prior to the succeeding charging sequence will result in an increase in the rate of dark decay of the photoconductor. This phenomenon, commonly referred to in the art as "fatigue", has in the past been avoided by the selection of photoconductive materials possessing rapid switching capacity. The most commercially successful photoconductive materials have been selenium and its alloys because of superior photosensitivity.

Organic photoconductive materials have been the subject of increasing interest recently. However, organic photoconductive materials typically are highly field dependent with respect to their efficiency of photogeneration of charge carriers. This characteristic results in a lower contrast potential for the electrostatic latent image than is the case for photoconductive materials where the photogeneration of charge carriers is not as highly field dependent. The present application relates to a single phase organic photoconductive composition which exhibits a shallow field dependence for the photogeneration of charge carriers.

SUMMARY OF THE INVENTION

It is therefore the object of this invention to provide a novel organic photoconductive composition.

It is another object of the invention to provide a single phase organic photoconductive composition capable of the efficient generation of charge carriers in response to activating electromagnetic radiation.

It is a further object of the invention to provide an organic photoconductive composition which exhibits a shallow field dependence for the photogeneration of charge carriers.

Other objects of the invention are to provide imaging members utilizing the above composition and the use of the imaging members in electrophotographic imaging methods.

BRIEF SUMMARY OF THE INVENTION

These and other objects and advantages are accomplished according to the invention by providing a single phase organic photoconductive composition which is made up of a solid solution of about 3.2 wt. % N-ethyl-3-tricyanovinylcarbazole, about 32.3 wt. % 2,5-bis(N,N-dimethylaminophenyl) oxadiazole and about 64.5 wt. % of a polycarbonate resin having recurring structural units represented by the formula

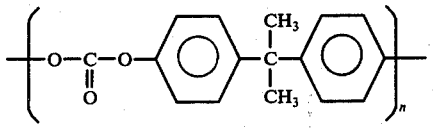

wherein $n$ is from about 150 to about 400 and preferably is about 200.

BRIEF DESCRIPTION OF THE DRAWINGS

The invention will be more readily understood from the following detailed description of various preferred embodiments thereof when read in connection with the accompanying drawings wherein.

DESCRIPTION OF THE PREFERRED EMBODIMENTS

Figure 1:
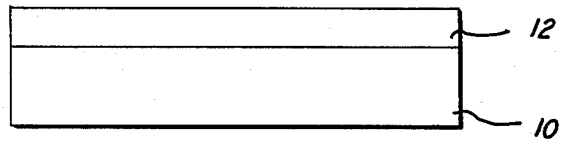
FIG. 1 is a partially schematic, cross-sectional view of an embodiment of an imaging member according to the invention.

The N-ethyl-3-tricyanovinylcarbazole, which is represented by the structural formula

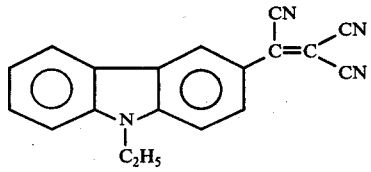

is capable of the rapid and efficient generation of charge carriers at the concentration in which it is present in the composition. The material is available commercially and can also be prepared by techniques which are well documented in the literature.

The 2,5-bis(N,N-dimethylphenyl)oxadizaole, which is represented by the structural formula

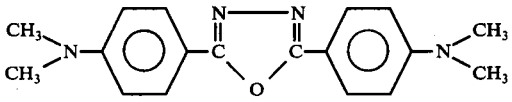

is capable of efficient transport of charge carriers at the concentration in which it is present in the composition. This compound is also available commercially and may also be prepared by known techniques.

The polymeric binder component of the photoconductive composition is a polycarbonate resin of the type described above. Such polycarbonate resins are readily commercially available and can be prepared by standard condensation polymerization techniques. Typical suitable polycarbonte resins for use in this composition include a resin marketed under the tradename Lexan (available from General Electric Company) and one marketed under the tradename Makrolon (available from Bayer Chemical). The resins suitable for use in the composition have a molecular weight which is sufficient to form a coherent solid film capable of retaining in solution the other components of the composition.

The single phase organic photoconductive composition can be prepared by combining the three components in the proper amounts in a common solvent such as chloroform and thereafter depositing a layer of the solution such as by coating or casting on an appropriate substrate. Upon removal of the solvent such as by evaporation under vacuum there is formed a coherent layer of the composition which is a solid solution of the components. The photoconductive layers prepared from the composition have excellent mechanical properties including good resistance to abrasion. As noted previously the composition exhibits a shallow electrical field dependence for the photogeneration of charge carriers and thus is capable of providing a high contrast potential electrophotographic system when used in an imaging member. The advantage of this property will be more fully appreciated from the discussion which follows.

As mentioned above, in electrophotography a photoconductive member is typically electrostatically charged such as by a corona charging means with the appropriate polarity of charge and an electrostatic latent image is then formed by imagewise exposing the member. The electrostatic latent image is the electrical charge pattern or the potential pattern on the surface of the member. The electrical fields which drive the development step are generally proportional to the difference in surface potentials and these differences are commonly called "contrast potentials". For a given initial potential one of the main factors which determines the magnitude of the contrast potential is the electrical field dependence of the charge carrier photogeneration processes. The quantum efficiency of photogeneration in any material is defined as the number of free carrier pairs generated per absorbed photon. For conventional photoreceptors irradiated with visible or near visible light the maximum number of carrier pairs that can be produced is unity but in actual practice it is generally less than unity. The quantum efficiency of generation can be a function of the applied electrical field, that is to say, the number of charge carrier pairs produced at a given electrical field could be different than that produced at any other field. Generally the quantum efficiency increases with increasing electric field. For amorphous selenium irradiated in the blue region of the spectrum ($\sim$ 4000 A radiation) the quantum efficiency varies approximatey with $E_\alpha$ where $\alpha \approx 0.5$. For the same exposure the number of charge carrier pairs produced at two different parts of the photoconductor with a field or potential variation of a factor of 10 is different by a factor of $10^{0.5}$. For hitherto known organic materials the field dependence of quantum efficiency is steeper. For example for a 1:1 charge transfer complex of poly(N-vinylcarbazole) and 2,4,7-trinitro-9-fluorenone the electrical field dependence of generation varies approximately as $E^{1.5}$. For the same exposure the number of charge carrier pairs produced at two different parts of the photoconductor with a field or potential variation of a factor of 10 is different by a factor of $10^{1.5}$. This steep field dependence results in a lower contrast potential compared to a photoconductor having a shallow field dependence, e.g., $E^{0.5}$.

This phenomenon can be examined by considering two regions on a photoreceptor with a 1.0 neutral density (factor of 10) variation in exposure. At the completion of the exposure step the area exposed to the lighter part of the object (the more intensely irradiated area of the photoreceptor) will have a lesser potential than that exposed to the darker region of the object. In the case of a photoreceptor with an electrical field independent photogeneration characteristic the contrast potential (the potential difference between the two regions) will be the highest since as the voltage drops in the more intensely irradiated area of the photoreceptor the efficiency of generation is not reduced as a result of the potential drop. However, in the case of a photoreceptor which has a steep dependence of photogeneration an electrical field, in those areas most intensely irradiated when the exposure is first incident on the photoreceptor the potential begins to drop which reduces the efficiency of generation of charge carriers on further illumination. The net result is that the potential in those areas is higher than it would be in the case of a shallow electrical field photogeneration dependent photoconductor.

The photoconductive composition of the invention may be used in various types of photoreceptors. Typically, a layer having a thickness in the range of from about 0.1 to about 200 microns is utilized in the photoreceptor, the precise thickness in any specific instance being determined principally by the type of photoreceptor.

Referring now to FIG. 1 there is seen a photoreceptor according to the invention which comprises a conductive substrate 10, Any of the substrate materials known for use in electrophotographic imaging members are suitable. Typical suitable materials include aluminum, chromium, nickel, brass, metal coated polymeric films (e.g., aluminized Mylar) and glass plates having conductive coatings. Layer 12 comprises the organic photoconductive composition of the invention.

The N-ethyl-3-tricyanovinylcarbazole component of the photoconductive composition is sensitive to light within the visible band of the electromagnetic spectrum and therefore photoactivation of the composition within the wavelength spectral response of that compound is generally preferred. The oxadiazole compound present within the photoconductive composition is also somewhat sensitive to light within the visible region of the electromagnetic spectrum and contributes to the overall photoresponse of the imaging member. Where the source of imaging energies also contains ultraviolet light the participation of the oxadiazole in the photogeneration of charge carriers will be increased. If it is desirable to extend the spectral response of the photoconductive composition beyond the range of photoresponse of the oxadiazole derivative and the carbazole compound, additional materials, such as dyes, can be added to the composition for this express purpose. The photoconductive composition prepared according to the invention favors the transport of positive charge carriers and therefore some trapping of electrons within the bulk of this composition can be expected. In order to minimize such electron trapping small amounts of an electron acceptor may be included in the composition. The electron acceptor should not be present in an amount that affects the overall photoresponse characteristics of the composition.

Figure 2:
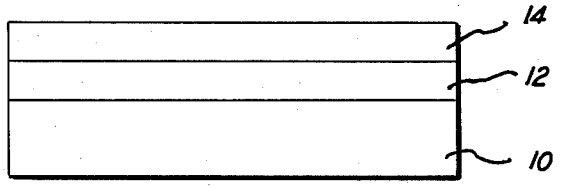
FIG. 2 is a partially schematic, cross-sectional view of another embodiment of an imaging member according to the invention.

FIG. 2 illustrates another embodiment of an imaging member according to the invention. This member is similar to that shown in FIG. 1 with the exception that it further includes an electrically insulating layer 14. Layer 14 is preferably clear and transparent and may comprise an electronically inert material, i.e., one that is incapable of effectively generating charge carriers in response to electromagnetic radiation within the wavelength region commonly used in electrophotography and also unable to effectively transport charge carriers injected into its bulk at reasonable field intensities. Typical suitable electronically inert materials include, for example, polyesters, polycarbonates, vinyl polymers such as polystyrene, copolymers thereof and blends and mixtures thereof. Alternatively layer 14 may comprise a material which is capable of rapidly and efficiently transporting at least one species of charge carrier. In this embodiment layer 14 may comprise a film of a charge carrier transporting material or a monomeric charge carrier transport material incorporated in a solid solution with an electronically inert polymeric binder material. Typical suitable monomeric charge carrier transporting materials are disclosed in U.S. Pat. Nos. 3,573,906 and 3,870,516. Of course it will be apparent to those skilled in the art that the imaging methods used in conjunction with these different members are dependent upon the characteristics of layer 14. The general types of members discussed with reference to FIG. 2 are known in the art and techniques for forming an electrostatic latent image on the surface thereof are known.

The invention will not be further described in detail with respect to a specific preferred embodiment by way of an example, it being understood that this intended to be illustrative only and the invention is not restricted to the processes and conditions therein. All parts and percentages are by weight unless otherwise stated.

EXAMPLE

About 64.5 parts of Lexan (a polycarbonate resin available from General Electrics Corp), about 32.3 parts of 2,5-bis(N,N-dimethylaminophenyl) oxadiazole and about 3.2 parts of N-ethyl-3-tricyanovinylcarbazole were dissolved in sufficient chloroform to prepare a 15 weight percent solution. This solution was coated on a ball grained deep etched 3003 aluminum alloy plate (a product of Richardson Graphics, Holyoke, Mass.) in a quantity sufficient to form a dry film having a thickness of approximately 18 microns. In order to insure substantially complete removal of solvent residues from the coating, the coated plate was placed in a vacuum for a period of about 12 hours. The plate was then evaluated xerographically by initially charging the surface of the 18 micron thick coating to a positive potential of approximately 60 volts per micron and then discharging the member with pulse excitation in the region of 4000 A - 5000 A. The peak contrast potentials obtained were 630, 300 and 210 volts for neutral densities of 1.0, 0.3 and 0.2 respectively. The light energy required to generate the contrast potentials was 120 ergs/cm$^2$.

Figure 3:
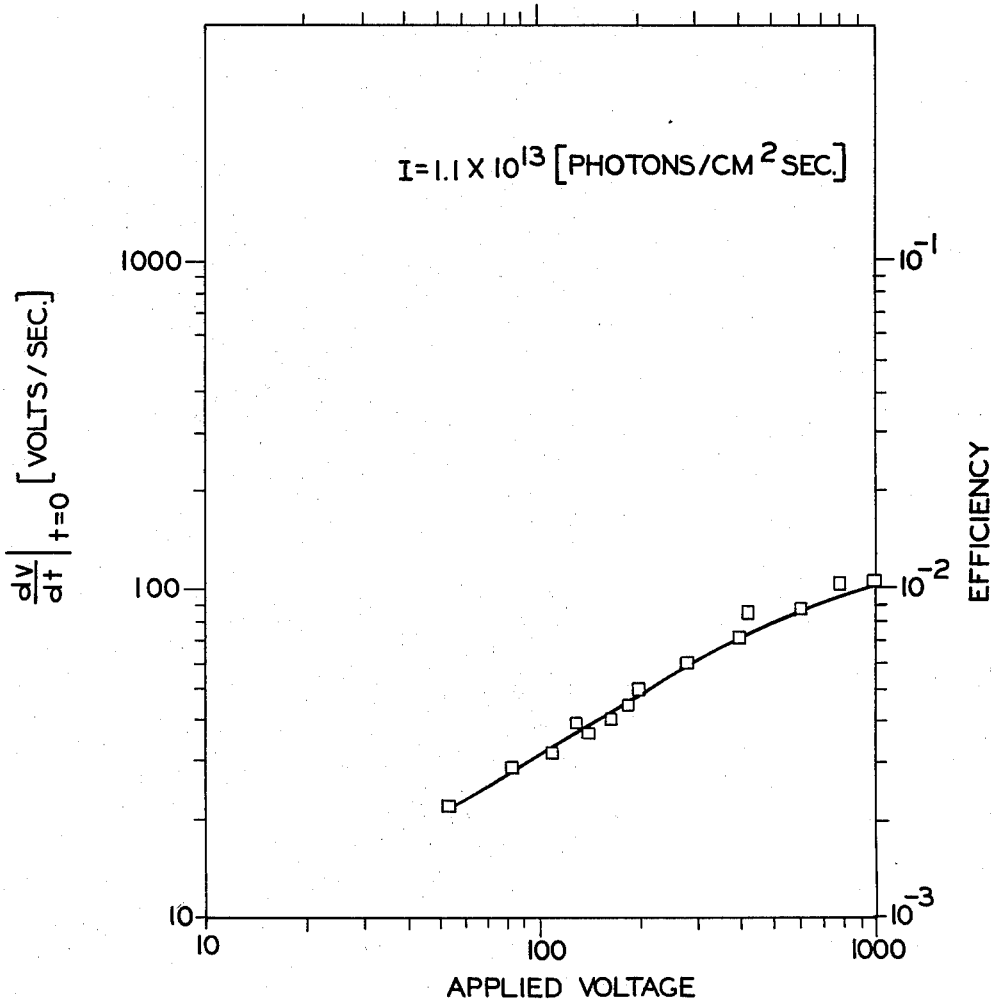
FIG. 3 illustrates the rate of discharge for the photoconductive composition as a function of electrical field for irradiation with 4000 A light.
Figure 4:
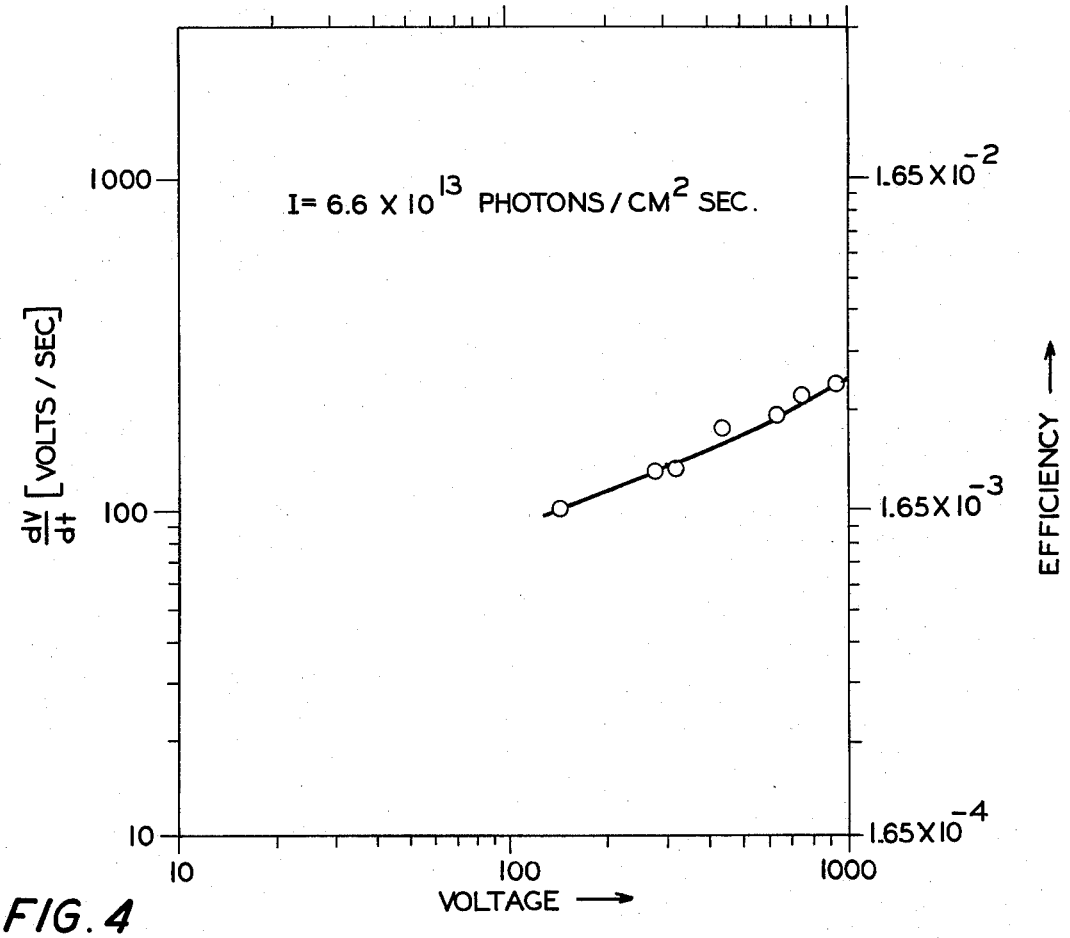
FIG. 4 illustrates the rate of discharge for the photoconductive composition as a function of electrical field for irradiation with 5000 A light.

FIGS. 3 and 4 illustrate the rate of discharge for the composition as a function of electrical field for irradition with 4000 A and 5000 A light respectively. The electrical field dependence of generation of the composition at both wavelengths varies approximately as $E^{0.5}$.

Figure 5:
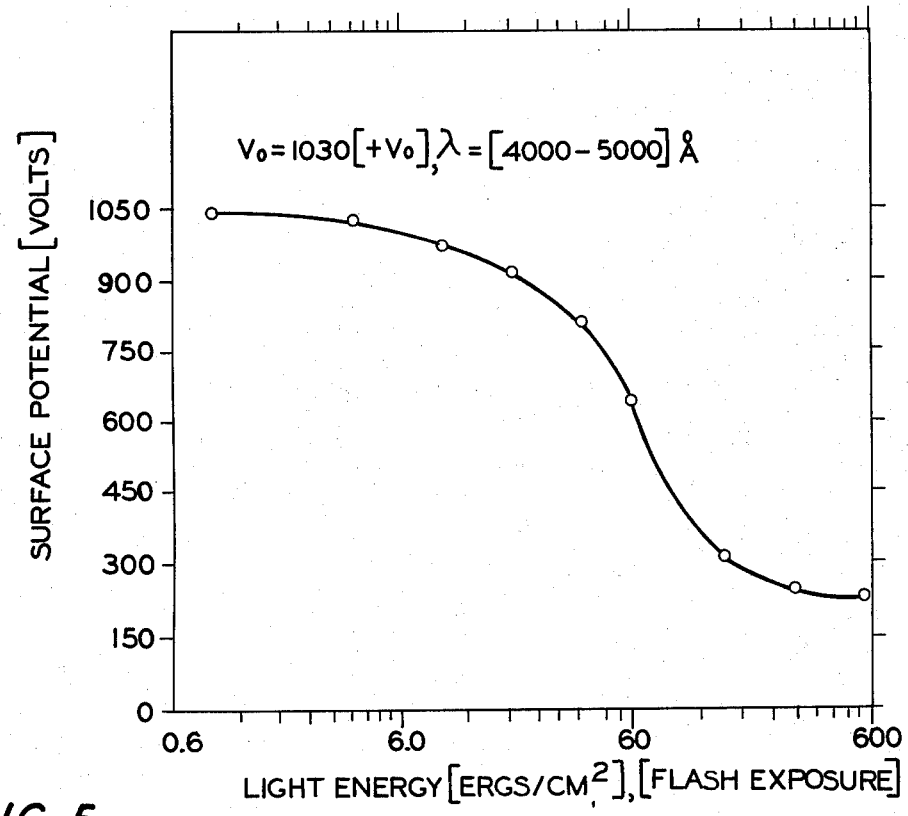
FIG. 5 is an illustration of the photoinduced discharge curve of the photoconductive composition.

FIG. 5 illustrates the photoinduced discharge curve (PIDC) for the composition. The PIDC is obtained by charging the member to an initial potential and subjecting it to a flash exposure of a given wavelength and intensity. The potential at the end of the discharge is one point of the PIDC. The member is discharged completely, allowed to rest and then the procedure is repeated by charging to the same initial potential but exposing to the same wavelength of light but at a different intensity. The voltage at the end of discharge is another point of the PIDC. Subsequent cycles are repeated by varying the intensity of exposure over a range and the entire PIDC is thus obtained. Hence, each point on the PIDC corresponds to a potential for that exposure level. The difference in potential between two points varying in light intensity by a factor of 10 is the contrast potential for a neutral density of 1.0 and the magnitude of this contrast potential is higher the shallower the field dependence of photogeneration. The PIDC clearly illustrates the shallow electrical field dependence of the photoconductive composition.

Although the invention has been described with respect to specific preferred embodiments, it is not intended to be limited thereto but rather those skilled in the art will recognize that variations and modifications may be made therein which are within the spirit of the invention and the scope of the claims.

What is claimed is:

1. An organic photoconductive composition consisting essentially of about 3.2 weight percent N-ethyl-3-tricyanovinylcarbazole, about 32.3 weight percent 2,5-bis(N,N-dimethylaminophenyl) oxadiazole and about 64.5% of a polycarbonate resin having recurring structural units represented by the formula

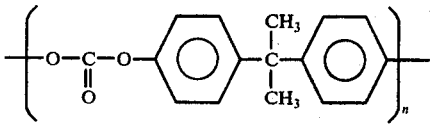

where $n$ is in the range of from about 150 to about 400.

2. The composition defined in claim 1 wherein $n$ is about 200.

3. A photoconductive imaging member comprising a conductive substrate and a photoconductive insulating layer of the composition of claim 2.

4. A photoconductive imaging member comprising a conductive substrate, a photoconductive insulating layer of the composition of claim 2 and an electrically insulating overcoating.

5. The member as defined in claim 4 wherein said overcoating is electronically inert.

6. The member as defined in claim 4 wherein said overcoating is capable of transporting at least one species of charge carrier.

* * * * *